US007469449B2

(12) United States Patent
Hsu

(10) Patent No.: US 7,469,449 B2
(45) Date of Patent: Dec. 30, 2008

(54) ROTATABLE HINGE

(75) Inventor: Jia-Hao Hsu, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 352 days.

(21) Appl. No.: 11/488,155

(22) Filed: Jul. 18, 2006

(65) Prior Publication Data

US 2008/0034547 A1 Feb. 14, 2008

(51) Int. Cl.
*E05D 3/10* (2006.01)

(52) U.S. Cl. ..... 16/367; 16/371; 455/575.3; 361/681

(58) Field of Classification Search ..... 16/367, 16/366, 374, 340, 319, 338, 341; 248/917; 455/575.3; 348/838; 345/169, 905; 715/864; 312/223.1; 349/58, 65; 361/681
See application file for complete search history.

(56) References Cited

U.S. PATENT DOCUMENTS 7,017,235 B2 * 3/2006 Lu et al. ..... 16/367
7,055,218 B2 * 6/2006 Lu et al. ..... 16/367
7,222,396 B2 * 5/2007 Lu et al. ..... 16/340
7,336,782 B2 * 2/2008 Watanabe et al. ..... 379/433.13
2005/0283949 A1 * 12/2005 Lu et al. ..... 16/367
2008/0034549 A1 * 2/2008 Lee et al. ..... 16/367
2008/0098568 A1 * 5/2008 Hsu ..... 16/367

* cited by examiner

*Primary Examiner*—Victor Batson
*Assistant Examiner*—Matthew Sullivan
(74) *Attorney, Agent, or Firm*—Posz Law Group, PLC

(57) ABSTRACT

A rotatable hinge has a rotatable bracket, a pivot bracket and a pivot shaft. The pivot bracket is mounted below the rotatable bracket and has two connecting walls perpendicularly formed on the pivot bracket and two stands mounted on the connecting walls. One connecting wall has a pivot hole and a pintle. The pintle extends in the pivot hole, allows the pivot bracket rotatably to be mounted with the pintle and has a limit. The limit is riveted on the pintle and has an inverse-V-shaped curved edge facing the pivot bracket. The curved edge has two slanted edges and an angle between the slanted edges. The pivot shaft is mounted securely with the rotatable bracket, is mounted rotatably with the pivot bracket and has an enlarged end selectively abutting the limit to make a rotation of the rotatable bracket depend on the angle.

6 Claims, 6 Drawing Sheets

ROTATABLE HINGE

BACKGROUND OF THE INVENTION

1. Field of Invention

The present invention relates to a rotatable hinge, and more particularly to a rotatable hinge being able to rotate when an angle between a base and a cover is from 85° to 95°.

2. Description of the Related Art

An electronic appliance such as a laptop or a mobile phone has a base, a cover and a hinge. The cover connects with the base and may have a camera lens. A hinge is usually mounted between the base and the cover, which pivots to open or close the cover and rotates the cover relatively to the base, so the camera lens on the cover is able to rotate and to face different directions.

However, the cover is unable to be rotated relatively to the base when an angle between the cover and the base is smaller than a specific angle. A conventional hinge can not limit the cover to rotate relative to the base before the angle between the cover and the base is equal or more than the specific angle. So when the angle between the cover and the base is smaller than the specific angle, the cover will be against to the base after being rotated and users have to rotate the cover back, enlarge the angle between the cover and the base and then rotate the cover again. That will waste users' time. If users know whether the cover is able to be rotated at the first time when they begins to rotate the cover, users can save their time and the cover will not be against to the base, so the cover and the base will not wear each other.

To overcome the shortcomings, the present invention provides a rotatable hinge to mitigate or obviate the aforementioned.

SUMMARY OF THE INVENTION

The primary objective of the present invention is to provide a rotatable hinge being able to rotate when an angle between a base and a cover is in an angle from 85° to 95°.

To achieve the objective, the rotatable hinge has a rotatable bracket, a pivot bracket and a pivot shaft. The pivot bracket is mounted below the rotatable bracket and has two connecting walls perpendicularly formed on the pivot bracket and two stands mounted on the connecting walls. One connecting wall has a pivot hole and a pintle. The pintle extends in the pivot hole, allows the pivot bracket rotatably to be mounted with the pintle and has a limit. The limit is riveted on the pintle and has an inverse-V-shaped curved edge facing the pivot bracket. The curved edge has two slanted edges and an angle between the slanted sides. The pivot shaft is mounted securely with the rotatable bracket, is mounted rotatably with the pivot bracket and has an enlarged end selectively abutting the limit to make a rotation of the rotatable bracket depend on the angle.

Other objectives, advantages and novel features of the invention will become more apparent from the following detailed description when taken in conjunction with the accompanying drawings.

DETAILED DESCRIPTION OF THE INVENTION

Figure 1:
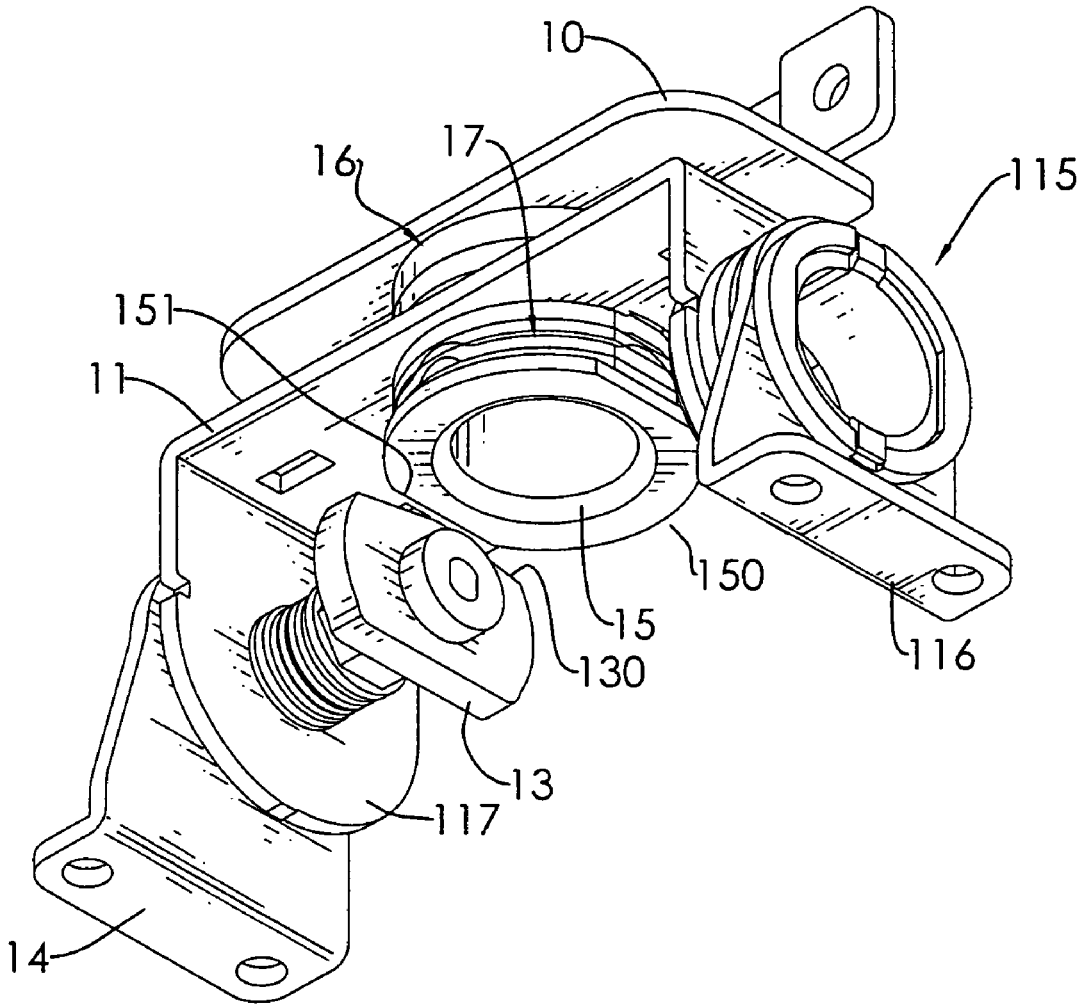
FIG. 1 is a perspective view of a rotatable hinge in accordance with the present invention.
Figure 2:
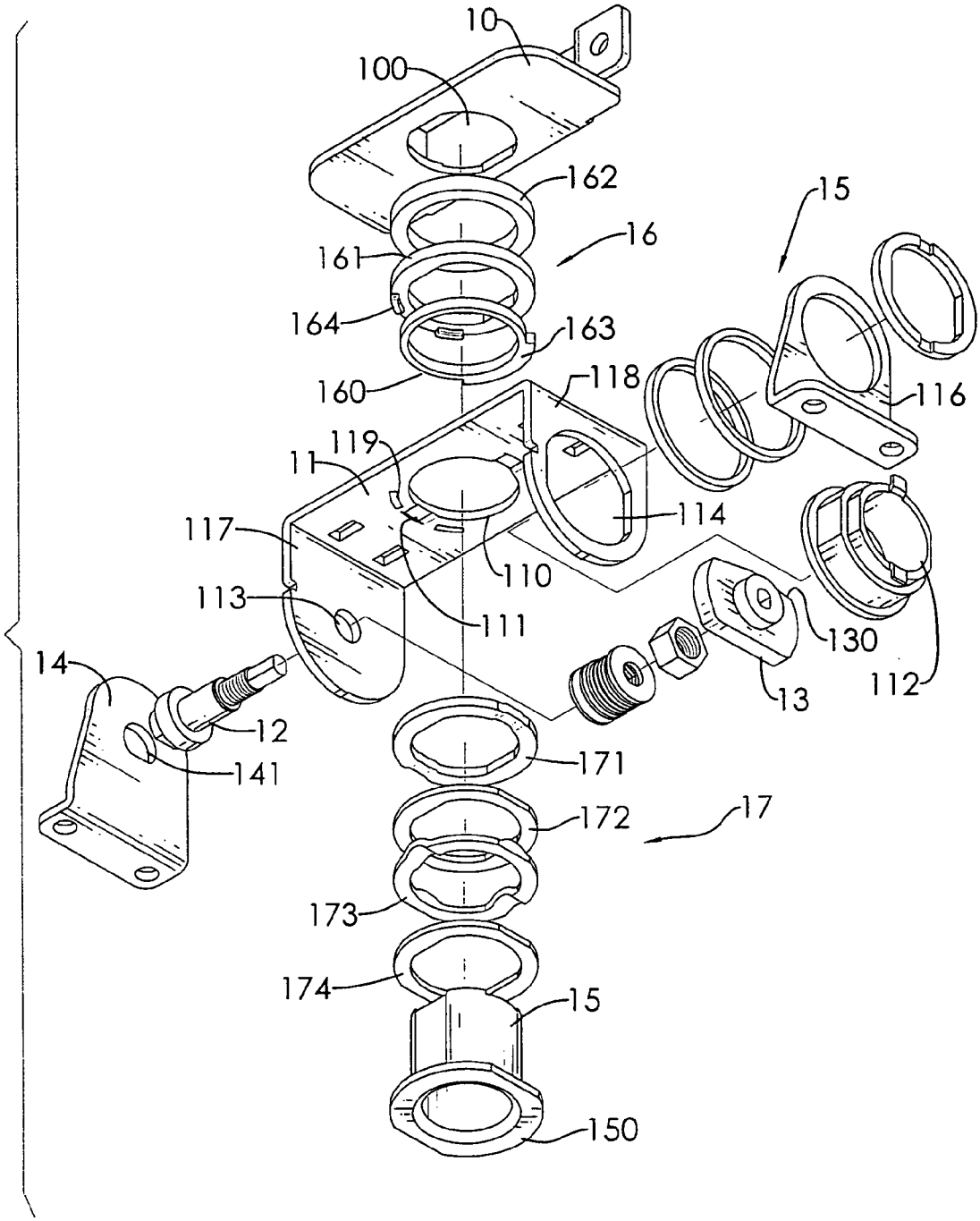
FIG. 2 is an exploded perspective view of the rotatable hinge in FIG. 1.
Figure 3:
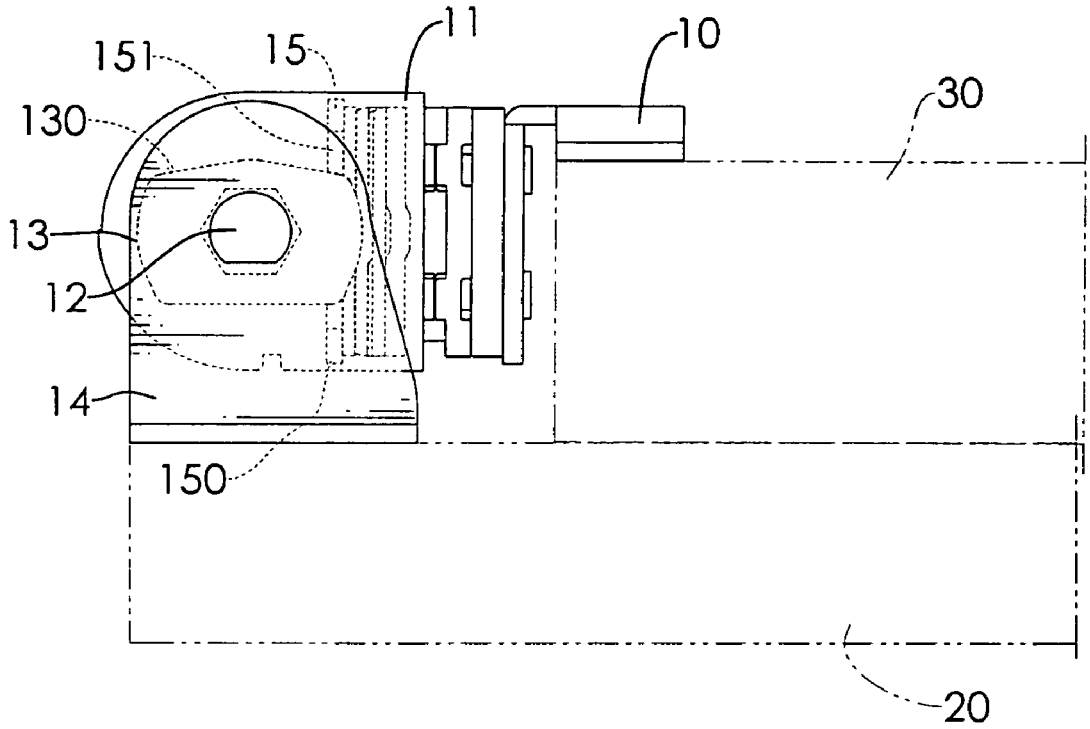
FIG. 3 is an operational side view of the rotatable hinge in FIG. 1 mounted between a cover and a base when the cover and the base are closed.

With reference to FIGS. 1, 2 and 3, a rotatable hinge in accordance with the present invention mounted in an electronic appliance with a base (20) and a cover (30) has a rotatable bracket (10), a pivot bracket (11), a pivot shaft (15), a limiting assembly (16) and a positioning assembly (17).

The rotatable bracket (10) securely connects with the cover (30) and has a non-circular central hole (100) defined through the rotatable bracket (10).

The pivot bracket (11) has a top surface, a bottom surface, two sides, a central circular hole (110), two limiting protrusions (119), multiple positioning slots (111), a first connecting wall (117), a second connecting wall (118), a pintle (12), a first stand (14) and a mounting assembly (115).

The top surface faces the rotatable bracket (10).

The central circular hole (110) is defined through the pivot bracket (11) and corresponds to the central hole (100) of the rotatable bracket (10).

The limiting protrusions (119) are mounted on the top surface of the pivot bracket (11) and are mounted close to the circular hole (110).

The positioning slots (111) are respectively formed in bottom surface of the pivot bracket (11) and may communicate with the circular hole (110).

The first connecting wall (117) is formed perpendicularly on one side of the pivot bracket (11) and has an inner surface, an outer surface and a riveting hole (113). The riveting hole (113) is defined through the first connecting wall (117).

The second connecting wall (118) is formed perpendicularly on the other side of the pivot bracket (11), is opposite to the first connecting wall (117) and has an inner surface, an outer surface and a non-circular mounting hole (114) defined through the second connecting wall (18).

The pintle (12) is mounted rotatably through the riveting hole (113) of the first connecting wall (117) and has a narrowed end, an enlarged end, a limit (13) and multiple washers. The narrowed end is adjacent to the inner surface of the first connecting wall (117). The enlarged end is adjacent to the outer surface of the first connecting wall (117). The limit (13) is riveted on the narrowed end of the pintle (12) and has a curved edge (130). The curved edge (130) faces the bottom surface of the pivot bracket (11), is inverse-V-shaped and has two slanted edges and an angle between the slanted sides. The angle may be 170°.

The first stand (14) is L-shaped, is mounted securely on the base (20), is adjacent to the outer surface of the first connecting wall (117) and has a pivoting hole (141). The pivoting hole (141) is defined through the first stand (14) and allows the enlarged end of the pintle (12) to extend in and be mounted securely in the pivot hole (141).

The mounting assembly (115) connects with the mounting hole (114) of the second connecting wall (118) and has a fastening element (112), multiple washers and a second stand (116). The fastening element (112) rotatably extends in the mounting hole (114). The washers are mounted around the fastening element (112). The second stand (116) is L-shaped, corresponds to the first stand (14), is mounted securely on the base (20), is mounted between the washers and has a through hole. The through hole is defined through the second stand (116) and allows the fastening element (112) to extend through the through hole. When the cover (30) is pivoted to open, the pivot bracket (11) and the rotatable bracket (10) pivot relative to the first stand (14), the pintle (12) and the second stand (116).

Figure 4:
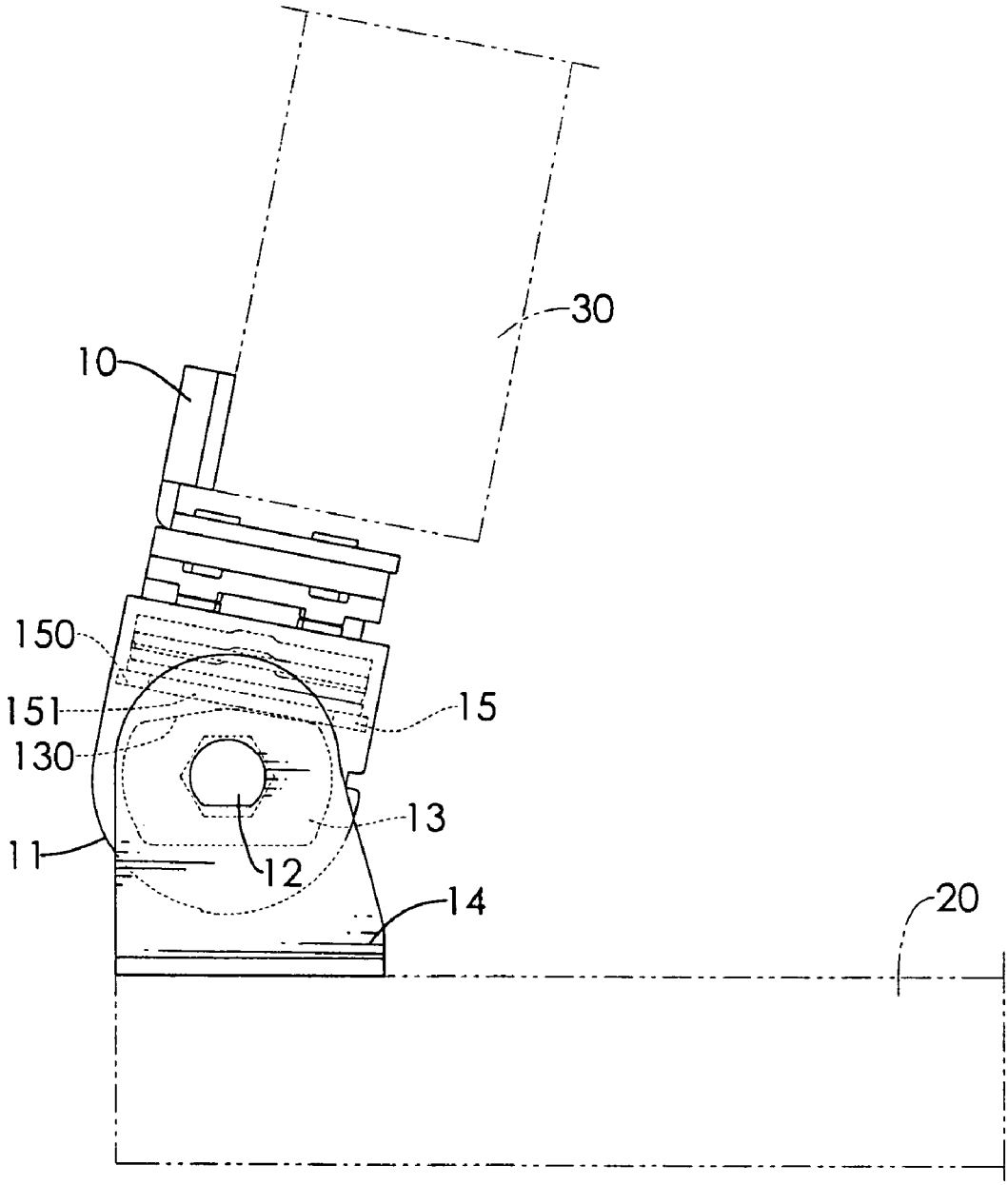
FIG. 4 is an operational side view of the rotatable hinge in FIG. 3 mounted between a cover and a base when an angle between the cover and the base is 85°.
Figure 5:
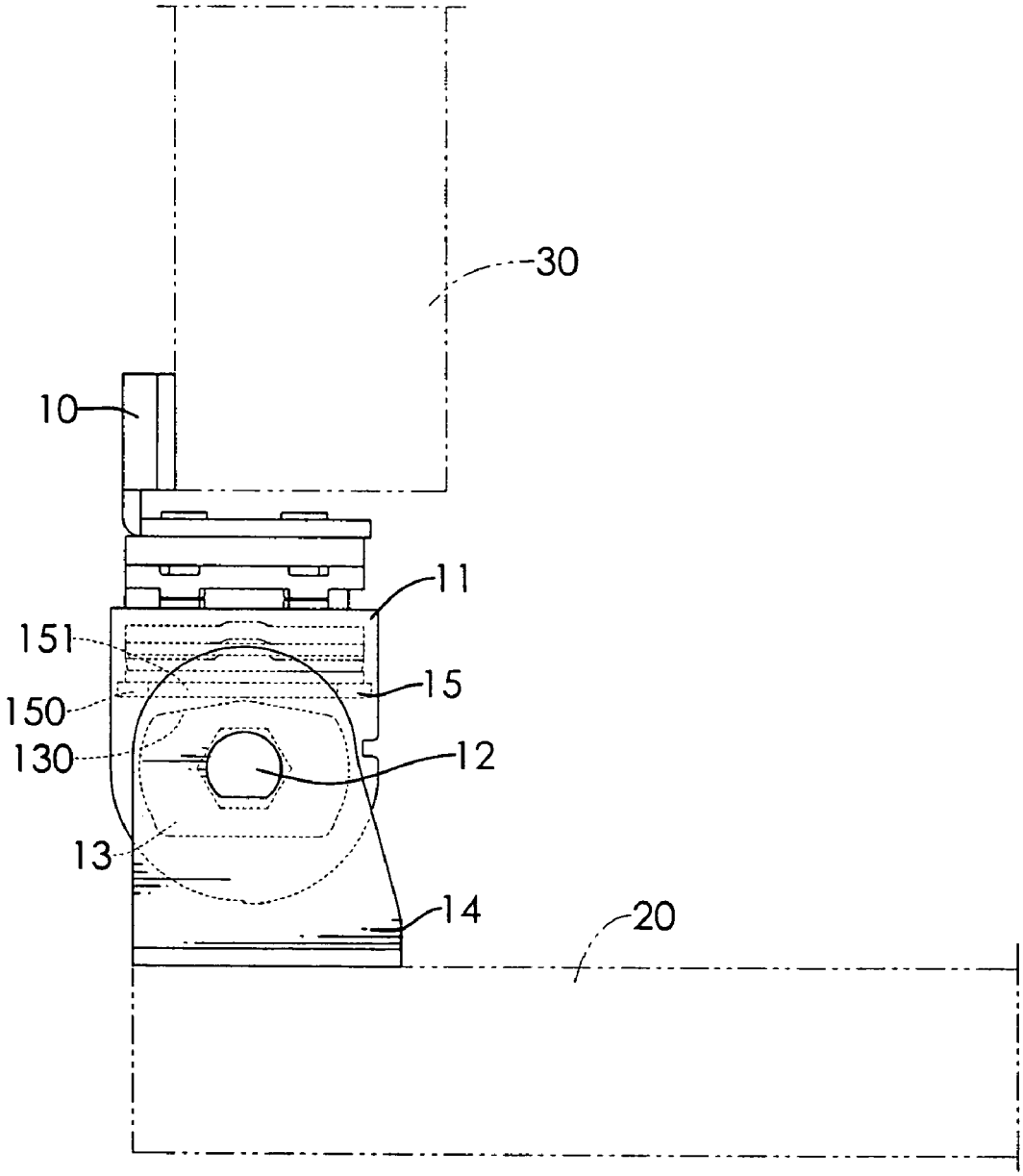
FIG. 5 is an operational side view of the rotatable hinge in FIG. 4 mounted between a cover and a base when an angle between the cover and the base is 90°.
Figure 6:
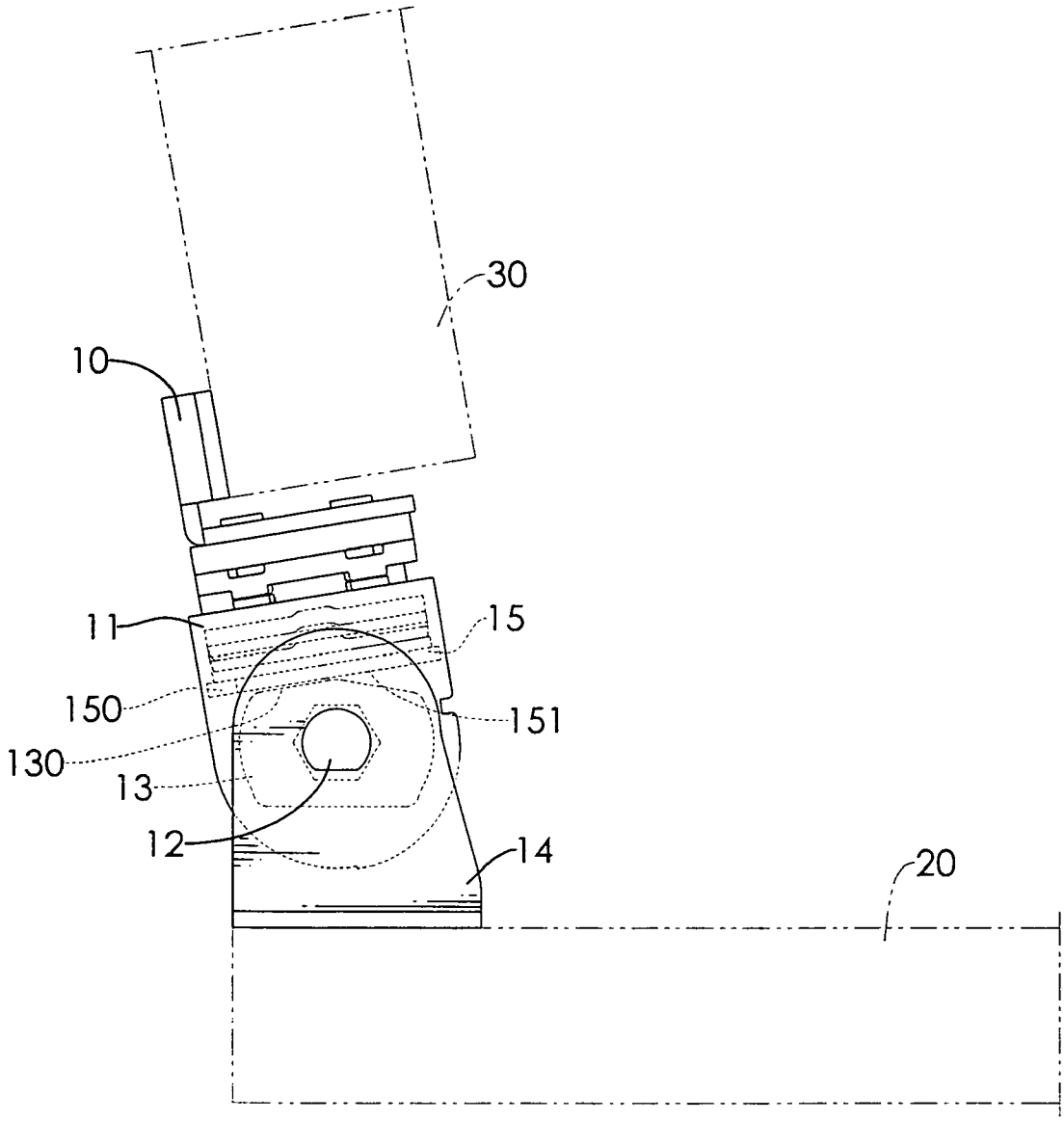
FIG. 6 is an operational side view of the rotatable hinge in FIG. 5 mounted between a cover and a base when an angle between the cover and the base is 95°.

With further reference to FIGS. 4 to 6, the pivot shaft (15) extends in the pivot bracket (11) and the rotatable bracket (10), is mounted rotatably in the circular hole (110) of the pivot bracket (11) and is mounted securely in the non-circular central hole (100) in the rotatable bracket (10). The pivot shaft (15) has an enlarged end (150). The enlarged end (150) abuts the bottom surface of the pivot bracket (11). If the cover (30) is desired to rotate relative to the base (20), the enlarged end (150) will abut and be blocked by the limit (13) to be incapable of rotating when an angle between the base (20) and the cover (30) is smaller than 85°, as shown in FIG. 3. Furthermore, the enlarged end (150) will be higher than the limit (13) and not abut the limit (13) to be capable of rotating when the angle between the base (20) and the cover (30) is between 85° to 95°, as shown in FIGS. 4-6.

The limiting assembly (16) is mounted around the pivot shaft (15), mounted between the rotatable bracket (10) and the pivot bracket (11) and has a limiting ring (160), an impetus ring (161) and at least one washer (162).

The limiting ring (160) is mounted rotatably around the pivot shaft (15), is mounted between the rotatable bracket (10) and the pivot bracket (11) and has an outer edge and a limiting tab (163). The limiting tab (163) is formed on the outer edge of the limiting ring (160) and has a first end and a second end. The first and second ends of the limiting tab (163) selectively contact the limiting protrusions (119) on the top surface of the pivot bracket (11) to limit the rotation of the rotatable bracket (10).

The impetus ring (161) is mounted securely around the pivot shaft (15), is mounted between the rotatable bracket (10) and the limiting ring (160) and has a bottom surface and two protrusions (164). The two protrusions (164) are formed on the bottom surface of the impetus ring (161) and selectively contact to the first and second ends of the limiting tab (163). One protrusion (164) contacts the first end of the limiting tab (163) and drives the limiting tab (163) to rotate clockwise relative to the pivot bracket (11) when the cover (30) rotates clockwise relative to the base (20) until the second end of the limiting tab (163) contacts one limiting protrusion (119) of the pivot bracket (11) to limit the rotation in one direction. The other protrusion (164) contacts the second end of the limiting tab (163) and drives the limiting tab (163) to rotate counterclockwise relative to the pivot bracket (11) when cover (30) rotates counterclockwise relative to the base (20) until the first end of the limiting tab (163) contacts the other limiting protrusion (119) of the pivot bracket (11) to limit the rotation in the other direction.

The washer (162) is mounted between the rotatable bracket (10) and the impetus ring (161).

The positioning assembly (17) is mounted around the pivot shaft (15), is mounted between the pivot bracket (11) and the enlarged end (150) of the pivot shaft (15) and has a positioning ring (171) and multiple resilient elements (172, 173, 174).

The positioning ring (171) is mounted securely around the pivot shaft (15), is adjacent to the bottom surface of the pivot bracket (11) and has multiple positioning protrusions (170). The positioning protrusions (170) correspond to the positioning slots (111) on the pivot bracket (11) and detachably engage respectively with the positioning slots (111) to position the pivot bracket (11).

The resilient elements (172, 173, 174) are mounted around the pivot shaft (15) and are mounted between the enlarged end (150) of the pivot shaft (15) and the positioning ring (171).

The cover (30) and the base (20) are able to rotate relative to each other when the angle between the cover (30) and the base (20) is in an extent from 85° to 95° and the enlarged end (150) of the pivot shaft (15) will not abut and be blocked by the limit (13). Thus, when the angle between the cover (90) and the base (80) is smaller than 85° or larger than 95°, users know the cover (90) can not be rotated at the first time, so users can save their time. In addition, the cover (30) will not be against the base (20), so the cover (30) and the base (20) will not wear each other.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A rotatable hinge having a rotatable bracket having a non-circular central hole defined through the rotatable bracket;

a pivot bracket having a bottom surface;

a central circular hole defined through the pivot bracket and corresponding to the central hole of the rotatable bracket;

a first connecting wall formed perpendicularly on one side of the pivot bracket and having an inner surface;

an outer surface; and a riveting hole defined through the first connecting wall;

a second connecting wall formed perpendicularly on the other side of the pivot bracket, being opposite to the first connecting wall and having an inner surface;

an outer surface; and a non-circular mounting hole defined through the second connecting wall;

a pintle rotatably mounted through the riveting hole of the first connecting wall and having a narrowed end being adjacent to the inner surface of the first connecting wall;

an enlarged end being adjacent to the outer surface of the first connecting wall; and a limit mounted on the narrowed end of the pintle and having a curved edge facing the bottom surface of the pivot bracket, being inverse-V-shaped and having two slanted edges; and an angle between the slanted sides;

a first stand being L-shaped, securely mounted on the base, being adjacent to the outer surface of the first connecting wall and having a pivoting hole defined through the first stand and allowing the enlarged end of the pintle to extend in and to be mounted securely in the pivot hole;

a mounting assembly connecting with the mounting hole of the second connecting wall and having a fastening element rotatably extending in the mounting hole; and a second stand being L-shaped, corresponding to the first stand to be mounted securely on the base, mounted between the washers and having a through hole defined through the second stand and the fastening element extending in the through hole;

a pivot shaft extending in the pivot bracket and the rotatable bracket, mounted rotatably in the circular hole of the pivot bracket, mounted securely in the non-circular central hole and having an enlarged end abutting the bottom surface of the pivot bracket.

2. The rotatable hinge as claimed in claim 1, wherein a positioning ring is securely mounted around the pivot shaft, is mounted between the enlarged end and the pivot bracket and has multiple positioning protrusions; and the pivot bracket further has multiple positioning slots corresponding to the positioning protrusions and the positioning protrusions detachably engage respectively with the positioning slots.

3. The rotatable hinge as claimed in claim 1, wherein a limiting ring is mounted rotatably around the pivot shaft, is mounted between the pivot bracket and the pivot bracket and has an outer edge; and a limiting tab formed on the outer edge of the limiting ring and having two ends;

an impetus ring is mounted securely around the pivot shaft, is mounted between the pivot bracket and the limiting ring and has an bottom surface; and two protrusions formed on the bottom surface of the impetus ring and selectively contacting the ends of the limiting tab; and the pivot bracket further has a top surface facing the rotatable bracket; and two limiting protrusions mounted on the top surface, mounted close to the circular hole and selectively contacting the ends of the limiting tab on the limiting ring.

4. The rotatable hinge as claimed in claim 1 further having multiple washers mounted around the fastening element and between the second connecting wall and the second stand.

5. The rotatable hinge as claimed in claim 2 further having multiple resilient elements mounted around the pivot shaft and between the positioning ring and the enlarged end of the pivot shaft.

6. The rotatable hinge as claimed in claim 3 further having at least one washer mounted around the pivot shaft and between the rotatable bracket and the impetus ring.

* * * * *